United States Patent [19]

Price et al.

[11] Patent Number: 5,071,204

[45] Date of Patent: Dec. 10, 1991

[54] DESK-TYPE COMPUTER WORK STATION

[75] Inventors: Macy J. Price, Golden; Matthew P. Drabczyk, Aurora, both of Colo.

[73] Assignee: Engineered Data Products, Inc., Broomfield, Colo.

[21] Appl. No.: 467,123

[22] Filed: Jan. 18, 1990

Related U.S. Application Data

[63] Continuation of Ser. No. 162,024, Feb. 29, 1988, abandoned, which is a continuation-in-part of Ser. No. 720,068, Apr. 5, 1985, Pat. No. 4,755,009.

[51] Int. Cl.[5] ..... H47B 17/00

[52] U.S. Cl. ..... 312/194; 312/208

[58] Field of Search ..... 312/194, 203, 209, 20, 312/7, 2, 279, 213, 223, 195, 190; 108/1, 4, 1 A; 248/132, 188.5, 133, 139, 18; D14/103

[56] References Cited

U.S. PATENT DOCUMENTS

| | | | |
|---|---|---|---|
| 948,377 | 2/1910 | Prouty | 312/196 X |
| 952,624 | 3/1910 | Mothersill | 312/196 |
| 1,427,249 | 8/1922 | Weston | 108/1 |
| 2,192,359 | 4/1940 | Cook et al. | 108/6 |
| 2,931,685 | 4/1960 | Butler | 312/196 |
| 3,000,681 | 9/1961 | Long | 312/194 |
| 3,192,306 | 6/1965 | Skonnord | 312/213 |
| 3,641,946 | 2/1972 | Charnay | 108/6 |
| 4,734,826 | 3/1988 | Wilson et al. | 312/223 |
| 4,755,009 | 2/1988 | Price et al. | 312/194 |

OTHER PUBLICATIONS

Jeff Guinn, "FW Man Markets Electronic Desk", 2/2/1985, Ed Schairbaum (2 pages).

Kathryn Jones, "High Tech Comes to Desk", Dallas Times Herald (undated).

The Electronic Desk "Inner Storage for Outer Space", 1985.

*Primary Examiner*—Joseph Falk

*Attorney, Agent, or Firm*—Klaas & Law

[57] ABSTRACT

A desk-type work station for a computer-type system apparatus is provided wherein a generally flat top panel having a central transparent portion is supported on a pair of laterally spaced apart supports to define a work space therebetween and beneath the central transparent portion so that a display screen movably supported beneath the central transparent portion may be readily viewed and a central drawer is provided on which is supported a keyboard-type input apparatus and wherein one component of the computer-type system apparatus is located in one of the supports and another component thereof is located in the other of the supports. A plurality of openings extend through the top panel to provide access openings to the components of the computer-type system apparatus and to provide passageways for the escape of heated air generated by the operation of the components and removable cover sections are provided for covering the openings with each of the removable cover sections having passageways for the removal of the heated air. Also, an auxiliary shelf is supported on the generally flat top panel and guides are provided for properly locating the auxiliary shelf on the generally flat top panel.

13 Claims, 4 Drawing Sheets

FIG. 3
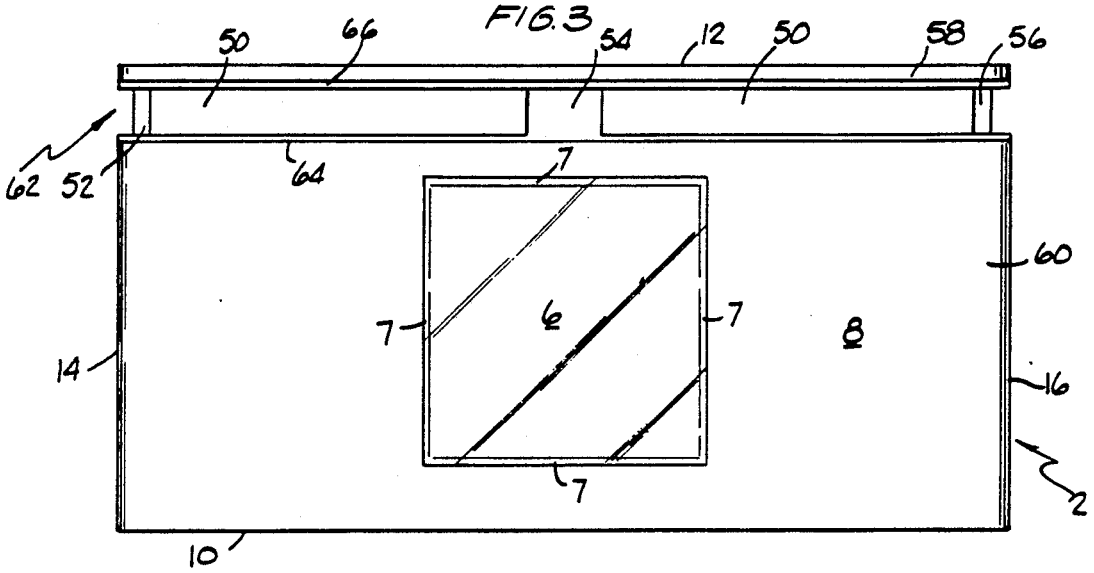
FIG 4
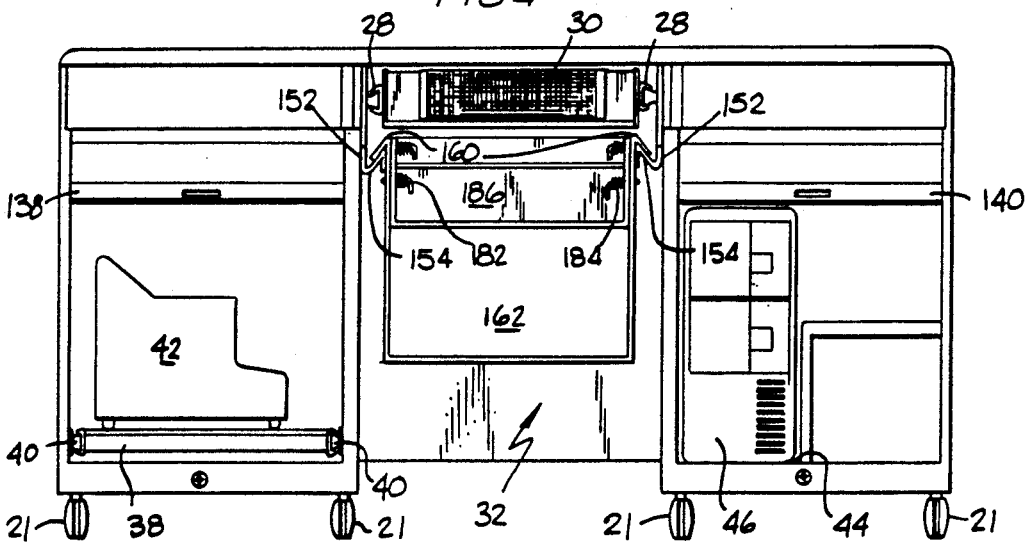
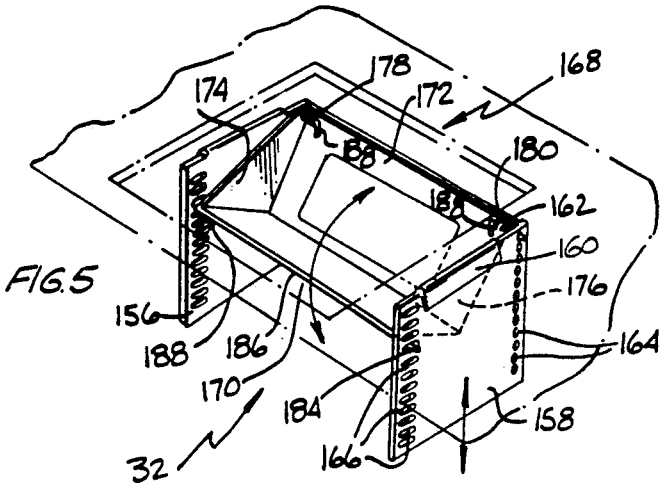
FIG. 5

FIG. 10
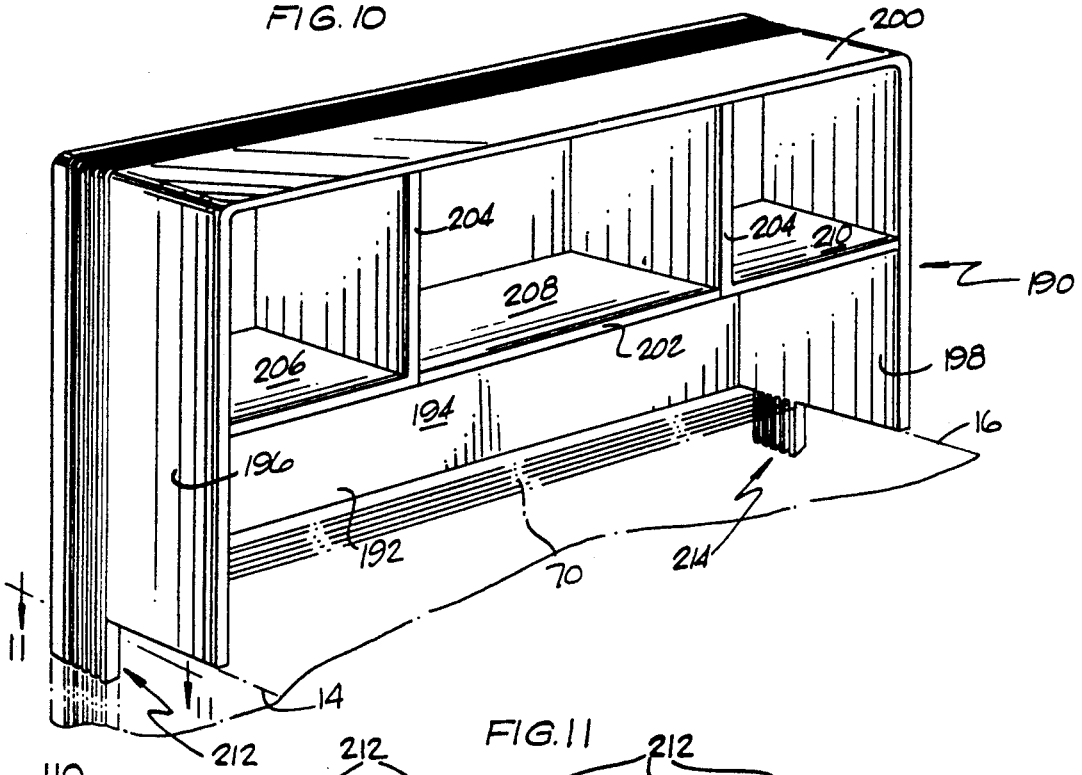
FIG. 11
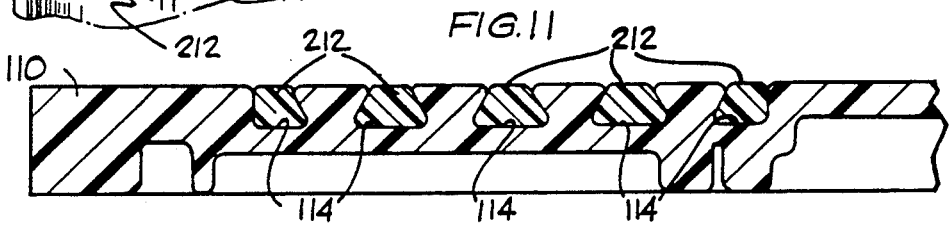
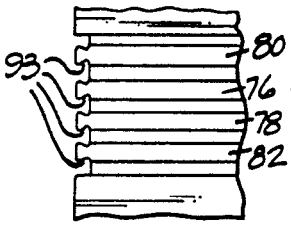
FIG. 7A
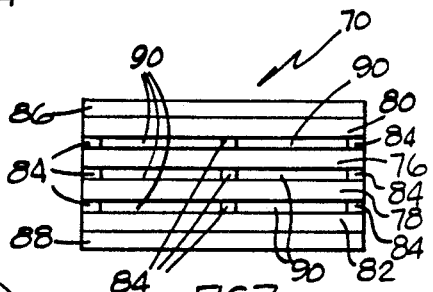
FIG. 7
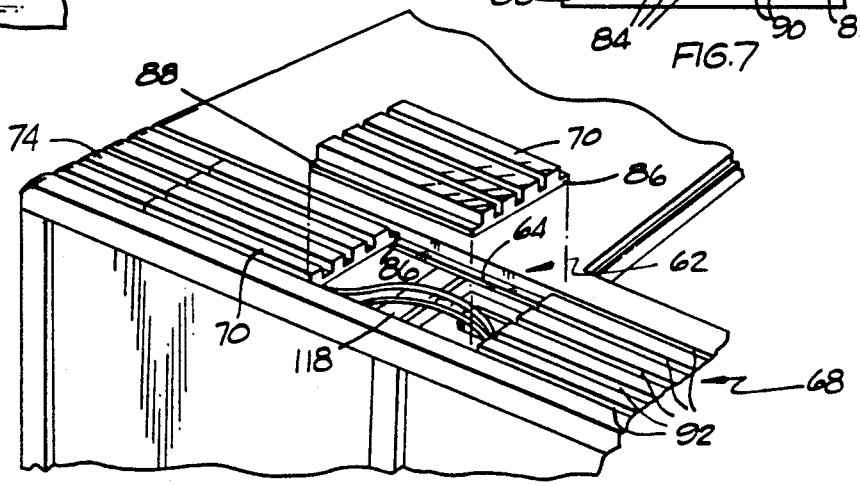
FIG. 6

DESK-TYPE COMPUTER WORK STATION

This application is a continuation of application of 07/162024 now abandoned which is a continuation-in-part application of U.S. patent application Ser. No 06/720,068 filed Apr. 5, 1985, now U.S. Pat. No. 4,755,009 dated July 5, 1988.

FIELD OF THE INVENTION

This invention relates to desk-type apparatus for housing components of a micro and personnel computer system comprising a CPU (central processing unit), a monitor, a keyboard, a printer and to other structures for aiding in the efficient use of such apparatus.

BACKGROUND OF THE INVENTION

For many years, great technological advances have been made in data and word processing equipment. At the present time, many new and improved computer-type word processing systems are being marketed. New and improved work station equipment for providing structures to house and support the various components of computer word processing systems have been developed so as to provide for more efficient use of the computer word processing system. While the work station equipment disclosed in the patent application ha been quite successful, there has been noted that some improvements relating to access to the components of the computer-type word processing systems, particularly to the cables therefor, and to a more efficient removal of the heated air generated by the operation of such components are desirable. Also it is desirable that the work station equipment be capable of cooperating with auxiliary equipment to provide more service.

BRIEF DESCRIPTION OF THE INVENTION

This invention provides a network desk having several means for supporting various components of a computer work station in convenient, useful locations with access means in an upper surface thereof for providing access to the electrical cables of the components which access also provides a passageway for the removal of heated air generated by the operation of the various components of the computer work station.

In the preferred embodiment of the invention, there is provided a desk-type work station for a data processing, computer-type system apparatus comprising an upper generally flat top panel means having a central transparent panel portion and an upper surface to provide support means for work product materials. The upper generally flat top panel means has at least a front edge portion, a back edge portion and two opposite side edge portions. A pair of laterally spaced apart support means are used to support the top panel means above a floor surface and also to cooperate in defining a work space between the pair of support means and beneath the central transparent panel portion. A central drawer means is located beneath the upper top panel means and between the pair of support means for receiving and supporting a keyboard-type input means. Movable shelf means have at least a portion thereof located beneath the central transparent panel portion for receiving and supporting a display unit having a display screen so that the display screen is viewable through the central transparent panel portion. A first shelf means is located in one of the pair of support means and a second shelf means is located in the other of the pair of support means, each of the shelf means receiving and supporting components of the computer-type system apparatus. Opening means are located adjacent to but spaced from the back edge portion and extend through the upper generally flat top panel means and are in fluid communication with the interior of each of the pair of support means and with the work space between the pair of support means to provide access means to the components of the computer-type system apparatus and passageways for the removal of heated air resulting from the operation of the components of the computer-type system apparatus. Removable cover means are used to cover the opening means and have at least one opening therein to form a passageway for the heated air. An auxiliary shelf means is provided and is removably supported on portions of the upper surface of the generally flat top panel means. Guide means are provided on the auxiliary shelf means and portions of the removable cover means for properly locating the auxiliary shelf means on the generally flat top panel means.

BRIEF DESCRIPTION OF THE DRAWING

An illustrative and presently preferred embodiment of the invention is shown in the accompanying drawing in which:

FIG. 3 is a top plan view of only the generally flat top panel means;

FIG. 4 is a front elevational view of the desk-type work station;

FIG. 5 is a perspective view of the movable shelf means for supporting a CRT;

FIG. 6 is an enlarged perspective view illustrating one section of the removable cover means;

FIG. 7 is a top plan view of the one section;

FIG. 7A is a top plan view of an end section;

FIG. 10 is a perspective view illustrating an auxiliary shelf means in position on the desk-type work station; and FIG. 11 is an enlarged cross-sectional view taken on the line 11—11 of FIG. 10.

DETAILED DESCRIPTION OF THE INVENTION

Figure 1:
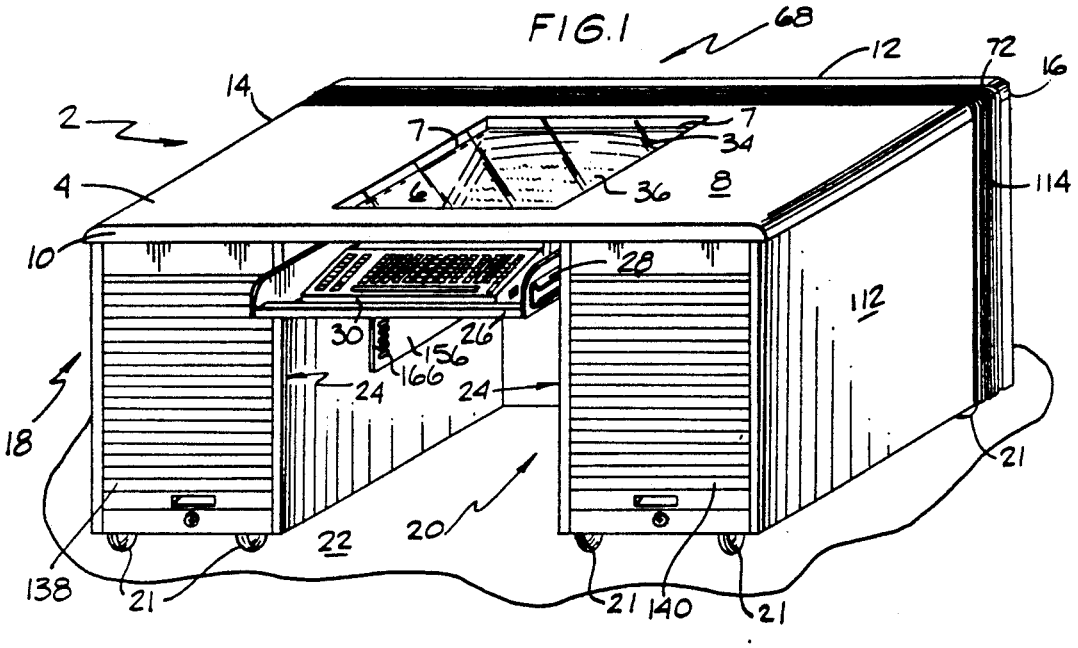
FIG. 1 is a perspective view of a desk-type work station.

In FIG. 1, there is illustrated a desk-type work station 2 comprising an upper generally flat top panel means 4 having a central transparent panel portion 6 supported by the ledges 7 (FIG. 3) and an upper surface 8 to provide support means for work product materials (not shown). The generally flat top panel means 4 is integrally molded using a relatively rigid plastic material such as urethane or styrene or other materials having similar characteristics. The upper generally flat top panel means 4 has a linearly extending front edge portion 10, a linearly extending back edge portion 12 parallel to the front edge portion 10 and two linearly extending, parallel opposite side edge portions 14 and 16. A pair of laterally spaced apart support means 18 and 20 are used to support the top panel means 4 above a floor surface 22 and to define a work space 24 between the pair of support means 18 and 20 and beneath the central transparent panel portion 6. A plurality of lockable rollers 21 are mounted in the support means 18 and 20 so that the desk-type work station 2 may be readily moved to a desired location. A central drawer means 26 is slidably mounted by conventional drawer slide apparatus 28 and is used to support a keyboard-type of input apparatus 30. Movable shelf means 32, illustrated more particularly in FIGS. 4 and 5, have at least a portion thereof located beneath the central transparent panel portion 6 and are used to support a display unit 34 having a display screen 36 so that the display screen 36 is viewable through the central transparent panel portion 6. First side shelf means 38 are slidably mounted in the support means 18 by conventional drawer slide apparatus 40 and function to support one component 42 of the computer-type system apparatus. Second side shelf means 44 in the support means 20 are used to support another component 46 of the computer-type apparatus.

Opening means 50, as illustrated in FIG. 3, are formed in the generally flat top panel means 4 and integral connecting strips 52, 54 and 56 are used to hold together a back side portion 58 and a front side portion 60 of the generally flat top panel means 4. The opening means 50 are in fluid communication with the interior of each of the pair of support means 18 and 20 and the work space 24 therebetween to provide access means to the components of the computer-type system apparatus and to provide a passageway for the escape of heated air resulting from the operation of the components. A recessed groove 62, illustrated in FIG. 3 and 6, is formed by a pair of recessed support ledges 64 and 66. The support ledges 64 and 66 extend between the side edges 14 and 16. Removable cover means 68 are used to cover the opening means 50, when access to the components is not necessary, and comprise a plurality of straight sections 70 and two L-shaped end sections 72 and 74. Each straight section 70, illustrated in FIG. 7, comprises two inner bars 76 and 78 and two outer bars 80 and 82 joined together by three integral holding means 84 at each end portion and the central portion thereof. Each of the outer bars 80 and 82 have support ledges 86 and 88 thereon for supporting each section 70 on the support ledges 64 and 66. The inner bars 76 and 78 and the outer bars 80 and 82 are spaced apart by the holding means 84 so as to provide a plurality of openings 90 extending therethrough for permitting passage of the heated air resulting from the operation of the components. The end sections 72 and 74 do not have any opening formed therein. The recessed groove 62 and the support ledges 64 and 66 are dimensioned so that, as illustrated in FIG. 1, when the straight sections 70 ar placed in the recessed groove 62, the outer surfaces thereof will lie in the same plane as the upper surface 8. The connecting strip 52 is spaced inwardly from the side edge portion 14 so that when the end section 72 is in position thereon, the inner surface of the end section 72 will abut against the connecting strip 52 so that the outer surface of the L-shaped portion of the end section 72 will be coextensive with the outer surface of the side edge portion 14. The connecting strip 56 is spaced inwardly from the side edge portion 16 so that when the end section 74 is in position thereon, the inner surface of the end section 74 will abut against the connecting strip 56 so that the outer surface of the L-shaped portion of the end section 74 will be coextensive with the outer surface of the side edge portion 16. Also, when the straight sections 70 and the end section 72 and 74 are positioned in the recessed groove 62, they form five grooves 92. The grooves 92 in the L-shaped portion of the end sections 72 and 74 lying in the side edge portion 14 and 16 have internal grooves 93, illustrated in FIG. 7A, for purposes described below.

Figure 2:
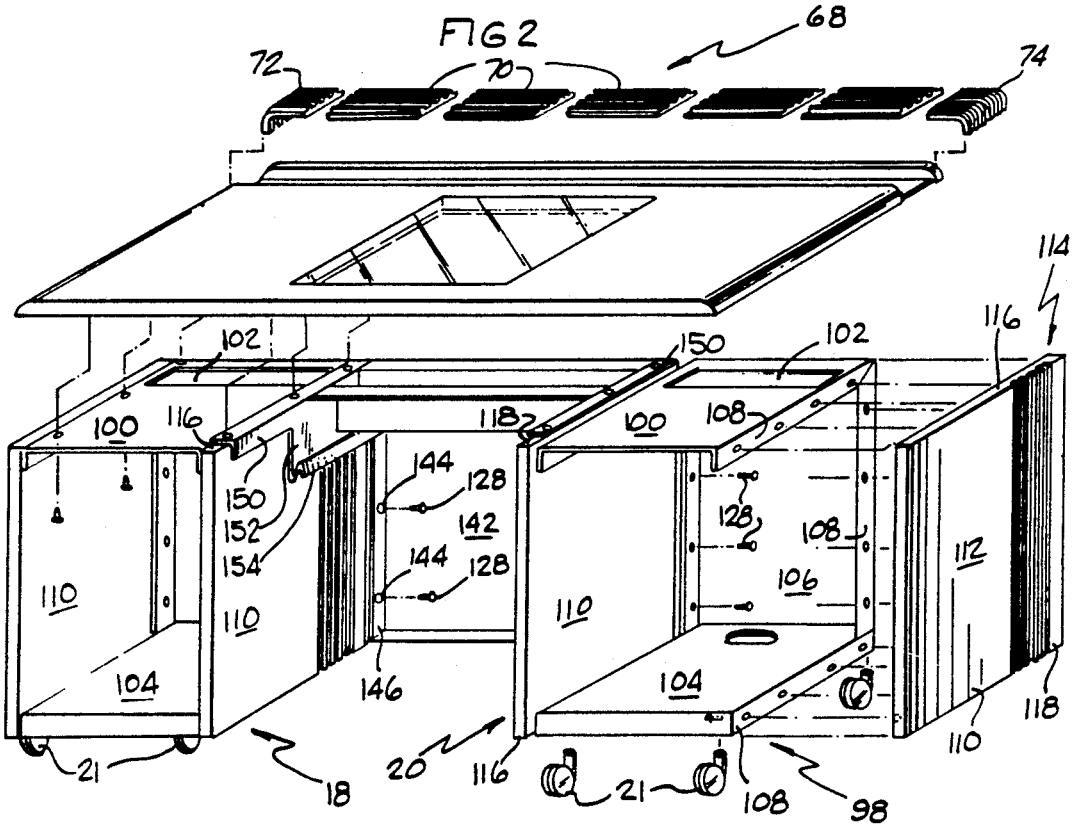
FIG. 2 is an exploded perspective view of several components of the desk-type work station.
Figure 8:
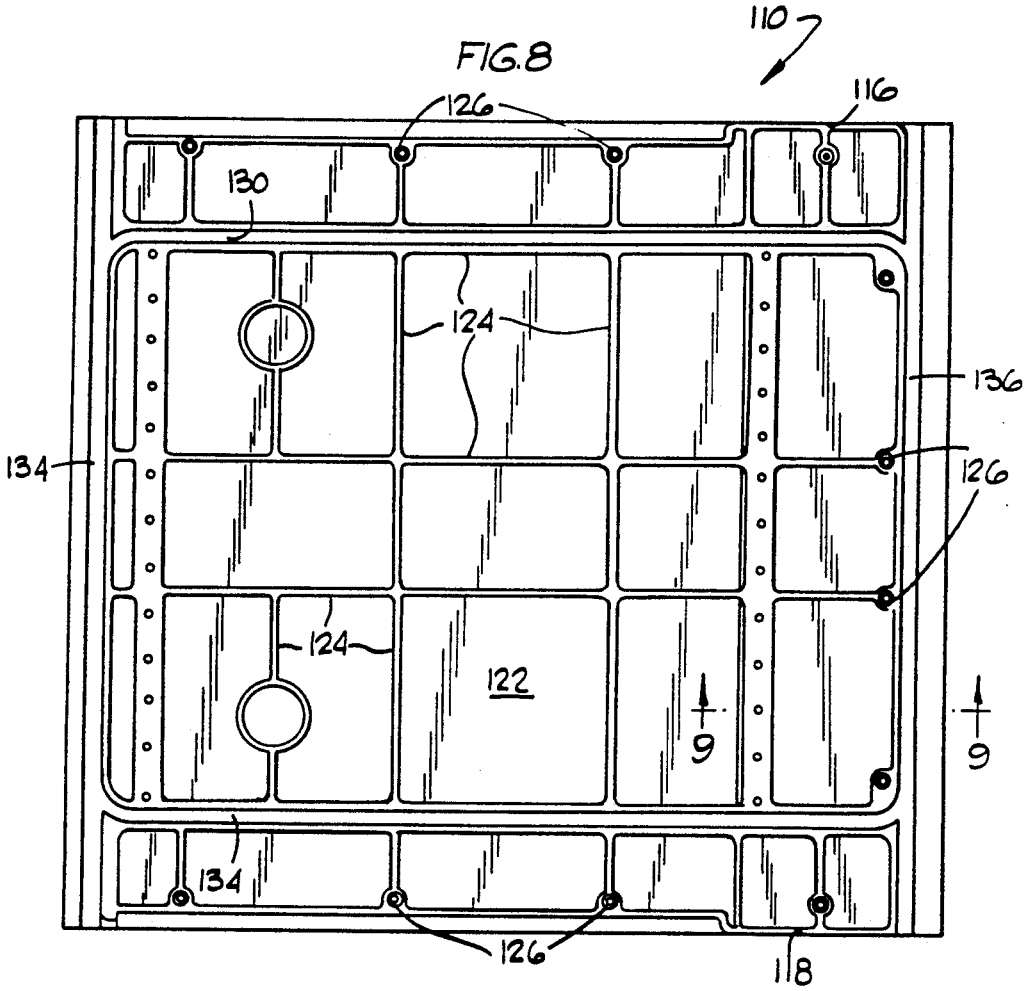
FIG. 8 is an elevational view of the inside portion of a side panel.
Figure 9:
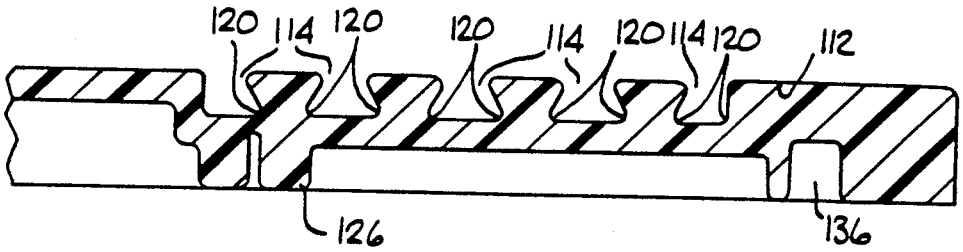
FIG. 9 is an enlarged cross-sectional view taken on the line 9—9 of FIG. 5.

The construction of the desk-type work station 2 is illustrated in FIG. 2. Each support means 18 and 20 comprises a metal frame 98 comprising a top section 100 having an opening 102 formed therein and in alignment with the opening means 50, a bottom section 104 and at least one upstanding section 106 connected to the top and bottom sections 102 and 104. Each of the sections 102, 104 and 106 have flange portions 108 for mounting of the side panels 110 thereon. The construction of the side panel 110 is illustrated in FIGS. 8 and 9 wherein the side panel 110 is integrally molded using a relatively high density plastic material, such as urethane or styrene or other materials having similar characteristics. Each side panel 110 is constructed so that it may be inverted and used either as the right hand side panel or the left hand side panel for the support means 18 or 20. The outer surface 112 of the side panel 110 is generally planar and is provided with five recessed grooves 114 extending between end surfaces 116 and 118. The recessed grooves 114 are formed with internal grooves 120 for purposes described below. As illustrated in FIG. 1, the recessed grooves 114 in the side panel 110 are in alignment with and are similarly shaped with the grooves 93 in the L-shaped end sections 72 and 74. The inner surface 122 of the side panel 110 has a plurality of reinforcing ribs 124 molded thereon and a plurality of apertures 126 for receiving threaded bolts 128 for securing each side panel 110 to the metal frame 98. The inner surface 122 is also provided with channel means 130, 132, 134 and 136 for receiving the conventional guide rollers (not shown) of the slidable cover means 138 and 140 for the pair of support means 18 and 20. The threaded bolts 128 are also used so secure a modesty panel 142 by passing through openings 144 formed in flange portions 146 thereof.

The movable shelf means 32 for supporting the display unit 34 are illustrated in FIGS. 2, 4 and 5 and comprise a fixed support 150 secured to one of the end surfaces 116 or 118 of the side panel 110. The fixed support 150 has a depending portion 152 terminating in an inverted V-shaped section 154. A pair of side support panels 156 and 158 are provided with V-shaped sections 160 which are positioned over the inverted V-shaped sections 154 so that the support panels 156 and 158 may be slidably moved over the inverted V-shaped sections 154. A reinforcing panel 162 extends between and is connected to the side support panels 156 and 158. Each of the side support panels 156 and 158 is provided with a plurality of vertically spaced apart openings 164 near the back side thereof and a plurality of vertically spaced apart horizontal slots 166 near the front side thereof. Adjustable shelf means 168 are provided and comprise a base member 170 and a back member 172 extending upwardly from the base member 170 at a ninety degree angle thereto. A pair of side panels 174 and 176 are secured to the base member 170 and 172 to hold them in the desired ninety degree relationship. Two spring loaded pins 178 and 180 of conventional construction are mounted on the back member 172 and are located so that the spring loaded pins will be urged into the openings 164 in the side support panels 156 and 158 to provide for vertical adjustment of the adjustable shelf means 168. Two spring loaded pins 182 and 184 of conventional construction are mounted on the bottom surface 186 of the base member 170 and are located so that the spring loaded pins 182 and 184 will be urged into the horizontal slots 166 to provide for angular adjustment of the adjustable shelf means 168. In use, the spring loaded pins 178 and 180 are retracted and the adjustable shelf means 168 are moved until the spring loaded pins 178 and 180 are opposite to and then move into the openings 164 required to provide for the proper vertical location for the display unit 34 to be supported on the adjustable shelf means 168. The two spring loaded pins 182 and 184 are then retracted using retracting means 188 and the adjustable shelf means 168 are pivoted until the spring loaded pins 182 and 184 are opposite to and then move into the slots 166 to provide for the proper angular location for the display unit 34 to be supported on the adjustable shelf means 168.

An auxiliary shelf means 190 is illustrated in FIG. 10 and comprises an upstanding main wall portion 192 extending parallel to the back edge portion 12 and having a front surface 194 located between the back edge portion 12 and the opening means 50. A pair of oppositely facing side wall portions 196 and 198 extend outwardly from the main wall portion 192 at ninety degree angles thereto and extend parallel to the side edge portions 14 and 16. A top cover portion 200 is supported on the main wall portion 192 and the side wall portions 196 and 198. Shelf means 202 are located between the top cover portion 200 and the generally flat top panel means 4 and are mounted on the main wall portion 192 and the side wall portions 196 and 198. Spaced apart partitions 204 extend between the shelf means 202 and the top cover means 200 to form three compartments 206, 208 and 210. A plurality of fingers 212 and 214 extend downwardly from each of the side wall portions 196 and 198. As illustrated in FIG. 11, the fingers 212 and 214 have cross-sectional configurations to mate with the cross-sectional configurations of the grooves 93 in the end sections 72 and 74 and the grooves 114 in the side panels 110. When the auxiliary shelf means 190 is being positioned on the desk-type work station 2, the fingers 212 and 214 are inserted into the grooves 93 in the end sections 72 and 74 and the auxiliary shelf means 190 is moved downwardly so that the fingers 212 and 214 enter the grooves 114 to locate the auxiliary shelf means 190 in the proper position on the desk-type work station 2.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A work station for holding and permitting operation of a computer system including a CRT device comprising:

an upper flat work surface means for providing an upper work surface;

a pair of laterally spaced pedestal means for supporting said upper flat work surface means;

an open space located beneath said upper flat work surface means and between said laterally spaced pedestal means;

transparent panel means in said upper flat work surface means located above said open space for enabling a computer operator to look into said open space therethrough;

support means located in said open space beneath said transparent panel means for supporting a CRT device in a position enabling the CRT device to be seen through said transparent panel means;

adjustable mounting means for adjustably mounting said CRT device on said support means; and at least one shelf means in one of said pedestal means for receiving and supporting at least one component of said computer system.

2. A desk-type work station for a data processing, computer-type system apparatus comprising:

an upper generally flat top panel means having a central transparent panel portion, said upper generally flat top panel means having an upper surface to provide support means for work product materials;

said upper generally flat top panel means having at least a front edge portion, a back edge portion and two opposite side edge portions;

a pair of laterally spaced apart support means for supporting said top panel means above a floor surface and defining a work space between said pair of support means and beneath said central transparent panel portion;

a central drawer means beneath said upper generally flat top panel means and between said laterally spaced apart support means for receiving and supporting a keyboard type input means;

movable shelf means having at least a portion thereof located beneath said central transparent panel portion for receiving and supporting a display means unit having a display screen so that said display screen is viewable through said central transparent panel portion;

first side shelf means located in one of said pair of support means for receiving and supporting a component of said computer-type system apparatus;

second side shelf means located in the other of said pair of support means for receiving and supporting another component of said computer-type system apparatus;

a plurality of openings extending through said upper generally flat top panel means and located adjacent to but spaced from said back edge portion and in fluid communication with the interior of each of said pair of support means and said work space between said pair of support means to provide access means to said components of said computer-type system apparatus and said display means unit and for providing a passageway for the escape of heated air resulting from the operation of said components of said computer-type system apparatus;

removable cover means for covering said opening means and having at least one opening therein for permitting passage of said heated air;

a recess extending downwardly from said upper surface to form a back portion and a front portion in said generally flat op panel means;

a plurality of spaced apart, integral connecting strips for connecting said back and front portions;

said plurality of connecting strips separating said opening means into said plurality of openings;

said recess having a pair of spaced apart support ledges;

said removable cover means being supported by said spaced apart support ledges;

said upper surface of said generally flat top panel means being generally planar;

said removable cover means when in position on said support ledges having an upper surface lying in the same plane as said upper upper surface of said generally flat top panel means;

said removable cover means comprise a plurality of separate sections; and wherein each of said plurality of separate sections comprises:

a plurality of linearly extending bars; and holding means for holding said bars in spaced apart parallel relationship so as to provide a plurality of openings in each of said sections for permitting passage of said heated air.

3. The invention as defined in claim 2 wherein:

said plurality of sections includes two L-shaped end sections supported on two of said connecting strips.

4. The invention as defined in claim 3 wherein:

each of said two opposite side edge portions having an outer surface; and each of said end sections when in position on said connecting strips having an outer surface which is coextensive with the outer surface of its associated side edge portion.

5. A desk-type work station for a data processing, computer-type system apparatus comprising:

an upper generally flat top panel means having a central transparent panel portion, said upper generally flat top panel means having an upper surface to provide support means for work product materials;

said upper generally flat top panel means having at least a front edge portion, a back edge portion and two opposite side edge portions;

a pair of laterally spaced apart support means for supporting said top panel means above a floor surface and defining a work space between said pair of support means and beneath said central transparent panel portion;

a central drawer means beneath said upper generally flat top panel means and between said laterally spaced apart support means for receiving and supporting a keyboard type input means;

movable shelf means having at least a portion thereof located beneath said central transparent panel portion for receiving and supporting a display means unit having a display screen so that said display screen is viewable through said central transparent panel portion;

first side shelf means located in one of said pair of support means for receiving and supporting a component of said computer-type system apparatus;

second side shelf means located in the other of said pair of support means for receiving and supporting another component of said computer-type system apparatus;

opening means extending through said upper generally flat top panel means and located adjacent to but spaced from said back edge portion and in fluid communication with the interior of each of said pair of support means and said work space between said pair of support means to provide access means to said components of said computer-type system apparatus and said display means unit and for providing a passageway for the escape of heated air resulting from the operation of said components of said computer-type system apparatus;

removable cover means for covering said opening means and having at least one opening therein for permitting passage of said heated air;

auxiliary shelf means removable supported on portions of said generally flat top panel means; and guide means on said auxiliary shelf means and on portions of said removable cover means for properly locating said auxiliary shelf means on said generally flat op panel means.

6. The invention as defined in claim 5 wherein:

said front edge portion and said back edge portion each extend in a linear direction and are in parallel relationship and said two opposite side edge portions each extend in a linear direction and are in parallel relationship; and wherein said auxiliary shelf means comprises:

an upstanding main wall portion extending parallel to said back edge portion and having a front surface located between said back edge portion and said opening means;

a pair of oppositely facing upstanding side wall portions extending outwardly from said main wall portion and extending parallel to said side edge portions;

a top cover portion supported on said main wall portion and said side wall portions; and shelf means located between said top cover portion and said generally flat top panel means and mounted on said main wall portion and said side wall portions.

7. The invention as defined in claim 6 wherein said opening means comprises:

a plurality of openings extending through said upper generally flat top panel means; and further comprising:

a recess extending downwardly from said upper surface to form a back portion and a front portion in said generally flat top panel means;

a plurality of spaced apart, integral connecting strips for connecting said back and front portions; and said plurality of support strips separating said opening means into said plurality of openings.

8. The invention as defined in claim 7 wherein:

said recess has a pair of spaced apart support ledges;

said removable cover means comprise a plurality of separate sections supported on said support ledges; and wherein each of said plurality of separate sections comprises:

a plurality of linearly extending bars;

holding means for holding said bars in spaced apart parallel relationship so as to provide a plurality of openings in each of said sections for permitting passage of said heated air; and at least two of said plurality of sections are L-shaped end sections supported on two of said connecting strips.

9. The invention as defined in claim 8 wherein:

each of said two opposite side edge portions have an outer surface; and each of said end sections when in position on said connecting strips having an outer surface which is coextensive with the outer surface of its associated side edge portion.

10. A desk-type work station for a data processing, computer-type system apparatus comprising:

an upper generally flat top panel means having a central transparent panel portion, said upper generally flat top panel means having an upper surface to provide support means for work product materials;

said upper generally flat top panel means having at least a front edge portion, a back edge portion and two opposite side edge portions;

a pair of laterally spaced apart support means for supporting said top panel means above a floor surface and defining a work space between said pair of support means and beneath said central transparent panel portion;

a central drawer means beneath said upper generally flat top panel means and between said laterally spaced apart support means for receiving and supporting a keyboard type input means;

movable shelf means having at least a portion thereof located beneath said central transparent panel portion for receiving and supporting a display means unit having a display screen so that said display screen is viewable through said central transparent panel portion;

first side shelf means located in one of said pair of support means for receiving and supporting a component of said computer-type system apparatus;

second side shelf means located in the other of said pair of support means for receiving and supporting another component of said computer-type system apparatus;

opening means extending through said upper generally flat top panel means and located adjacent to but spaced from said back edge portion and in fluid communication with the interior of each of said pair of support means and said work space between said pair of support means to provide access means to said components of said computer-type system apparatus and said display means unit and for providing a passageway for the escape of heated air resulting from the operation of said components of said computer-type system apparatus;

removable cover means for covering said opening means and having at least one opening therein for permitting passage of said heated air; and wherein said movable shelf means comprises:

support means mounted on each of said side panels facing said work space and each of said supporting means having an inwardly extending inverted V-shaped section;

a pair of spaced apart side support panels;

a reinforcing panel extending between and connected to said side support panels;

said side support panels having outwardly extending V-shaped sections which are supported on said inverted V-shaped sections for sliding movement thereover;

shelf means extending between said side support panels; and adjustment means for adjustably mounting said shelf means on said side support panels.

11. The invention as defined in claim 10 wherein said adjustment means comprises:

vertical adjustment means; and angular adjustment means.

12. The invention as in claim 11 wherein said vertical adjustment means comprises:

a plurality of spaced apart openings in each of said side walls extending in a vertical direction;

a pair of spring urged pins mounted on said shelf means so that said spring urged pins are normally urged in a direction to be received in one of said openings; and retracting means for retracting said spring urged pins so that said shelf means may be positioned with said spring urged pins opposite the openings to provide for the proper vertical location of said shelf means; and wherein said angular adjustment means comprises:

a plurality of spaced apart slots in each of said side walls extending in a vertical direction;

a pair of spring urged pins mounted on said shelf means so that said spring urged pins are normally urged in a direction to be received in one of said slots; and retracting means for retracting said spring urged pins so that said shelf means may be positioned with said spring urged pins opposite the slots to provide for the proper vertical location of said shelf means.

13. A desk-type work station for a data processing, computer-type system apparatus comprising:

an upper generally flat top panel means having a central transparent panel portion, said upper generally flat top panel means having an upper surface to provide support means for work product materials;

said upper generally flat top panel means having at least a front edge portion, a back edge portion and two opposite side edge portions;

a pair of laterally spaced apart support means for supporting said top panel means above a floor surface and defining a work space between said pair of support means and beneath said central transparent panel portion;

a central drawer means beneath said upper generally flat top panel means and between said laterally spaced apart support means for receiving and supporting a keyboard type input means;

movable shelf means having at least a portion thereof located beneath said central transparent panel portion for receiving and supporting a display means unit having a display screen so that said display screen is viewable through said central transparent panel portion;

at least one side shelf means located in one of said pair of support means for receiving and supporting a component of said computer-type system apparatus;

a plurality of openings extending through said upper generally flat top panel means and located adjacent to but spaced from said back edge portion and in fluid communication with the interior of each of said pair of support means and said work space between said pair of support means to provide access means to said components of said computer-type system apparatus and said display means unit and for providing a passageway for the escape of heated air resulting from the operation of said components of said computer-type system apparatus;

removable cover means for covering said opening means and having at least one opening therein for permitting passage of said heated air; and wherein said opening means comprises:

a recess extending downwardly from said upper surface to form a back portion and a front portion in said generally flat top panel means;

a plurality of spaced apart, integral connecting strips for connecting said back and front portions;

said plurality of connecting strips separating said opening means into said plurality of openings;

said recess having a pair of spaced apart support ledges;

said removable cover means being supported by said spaced apart support ledges;

said upper surface of said generally flat top panel means being generally planar;

said removable cover means when in position on said support ledges having an upper surface lying in the same plane as said upper surface of said generally flat top panel means;

said removable cover means comprise a plurality of separate sections; and wherein each of said plurality of separate sections comprises:

a plurality of linearly extending bars; and holding means for holding said bars in spaced apart parallel relationship so as to provide a plurality of openings in each of said sections for permitting passage of said heated air.

* * * * *